United States Patent [19]

Beck et al.

[11] 3,948,458

[45] Apr. 6, 1976

[54] REEL FOR ELONGATED CONVOLUTABLE OBJECTS

[75] Inventors: Christian Beck, Porz; Wilhelm Esser, Leverkusen; Wilhelm Kraft, Nurnberg; Kurt Scholtis, Nordenham, all of Germany

[73] Assignee: Felten & Guilleaume Carlswerk Aktiengesellschaft, Cologne-Mulheim, Germany

[22] Filed: Sept. 10, 1974

[21] Appl. No.: 504,758

[30] Foreign Application Priority Data

Sept. 12, 1973 Germany ..... 2345946

[52] U.S. Cl. ..... 242/118.7

[51] Int. Cl.[2] ..... B65H 75/14

[58] Field of Search ..... 242/118.31, 118.4, 118.6, 242/118.61, 118.62, 118.7, 71.8, 71.8 A; 206/399, 400

[56] References Cited

UNITED STATES PATENTS

| | | | |
|---|---|---|---|
| 2,053,815 | 9/1936 | DePanthou et al. | 242/71.8 A |
| 2,109,170 | 2/1938 | Gleason | 206/399 |
| 2,426,464 | 8/1947 | Menking | 242/118.6 |
| 2,563,198 | 8/1947 | Thalhammer | 242/71.8 A |
| 3,322,373 | 5/1967 | Wilson, Jr. et al. | 242/118.7 |
| 3,584,819 | 6/1971 | Brough | 242/118.61 |
| 3,599,893 | 8/1971 | Landolf et al. | 242/118.7 |
| 3,857,530 | 12/1974 | Mobey | 242/118.7 |

*Primary Examiner*—Leonard D. Christian
*Attorney, Agent, or Firm*—Michael J. Striker

[57] ABSTRACT

A reel for cable and the like has a tubular core portion having opposite open ends and a hollow interior formed with reinforcing ribs. A pair of end flanges is provided, each having a radially inner annular flange portion which is cupped so as to a have an open side facing axially inwardly of the core portion and which is, in part, received in one of the open ends, and a radially outer annular flange portion which is cupped so as to have an open side facing axially of the core portion and which has an outer circumferential edge face. Connecting portions connect the end flanges to the core portion.

19 Claims, 5 Drawing Figures

REEL FOR ELONGATED CONVOLUTABLE OBJECTS

BACKGROUND OF THE INVENTION

The present invention relates generally to a reel, and in particular to a reel for elongated convolutable objects, such as cables and the like.

Reels made of synthetic plastic material for wires cables and other convolutable elongated objects, are considered very desirable by the industry for a variety of reasons, including the economy of manufacture and the relatively low weight of such reels. The prior art has indeed proposed reels of synthetic plastic material, for instance a reel having a tubular core to which two end flanges are connected which are in form of circular plates, and which are held together by threaded rods extending lengthwise of the core and connecting the flanges of the latter. Experience has shown, however, that the connection of the end flanges with the core is not reliable in this prior-art reel. The threaded rods are of metal, whereas the core of the plate-shaped end flanges are of synthetic plastic material. This means differential coefficients of thermal expansion and contraction of the two materials, and in conjunction with cooled flowing of the synthetic plastic material has been found to result in unintended and undesired loosening of the connection of the flanges to the core.

A further type of reel of synthetic plastic material utilizes two identical reel portions which are symmetrical to one another and which are bonded together by an adhesive. These reels are suitable only if they do not exceed a certain size; they cannot be used where the reel must have large dimensions because they do not provide for sufficient strength and stability.

It is therefore desirable to provide a reel of synthetic plastic material which avoids the disadvantages of the prior art.

SUMMARY OF THE INVENTION

Accordingly, it is an object of the present invention to provide a reel for elongated convolutable objects, particularly for cables and the like, which is of synthetic plastic material and which avoids the aforementioned disadvantages.

More particularly, it is an object of the present invention to provide such a reel which has great strength and resistance to deformation.

An additional object of the invention is to provide such a reel which is inexpensive to manufacture.

A further object of the invention is to provide a reel of the type in question in which the end flanges are connected with a core of the reel in a simple and fully reliable manner.

A further object of the invention is to provide such a reel which despite its strength and resistance to deformation has a certain amount of elasticity.

Still a further object of the invention is to provide such a reel which will turn true when rotated.

In keeping with these objects, and with others which will become apparent hereafter, one feature in the invention resides in a reel for elongated convolutable objects, particularly for cables and the like, comprising a tubular core portion having opposite open ends and a hollow interior formed with reinforcing ribs. A pair of end flanges is provided, each having a radially inner annular flange portion which is cupped so as to have an open side facing axially inwardly of the core portion and which is in part received in one of the open ends, and a radially outer annular flange portion which is cupped so as to have an open side facing axially outwardly of the core portion and which has an outer circumferential edge face. Connecting means connects each of the end flanges to the core portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
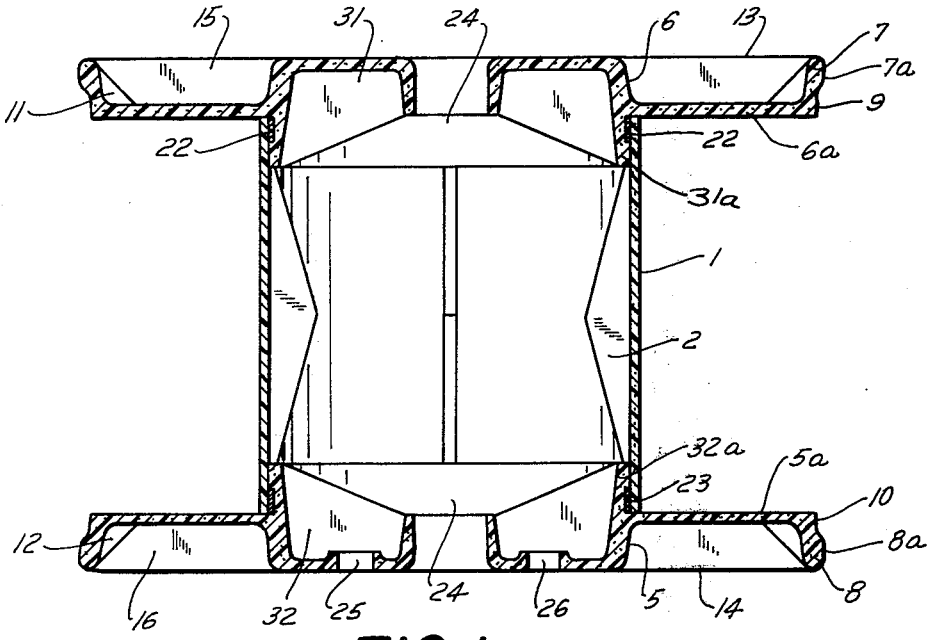
FIG. 1 is an axial section of a reel according to the present invention.
Figure 2:
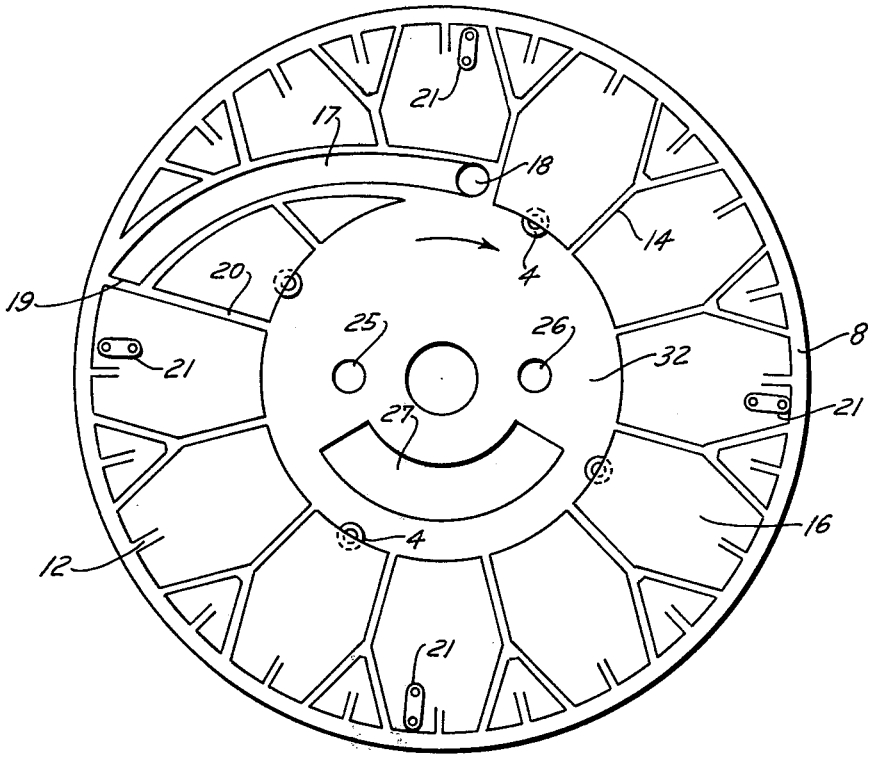
FIG. 2 is an end view of FIG. 1 looking upwardly.
Figure 3:
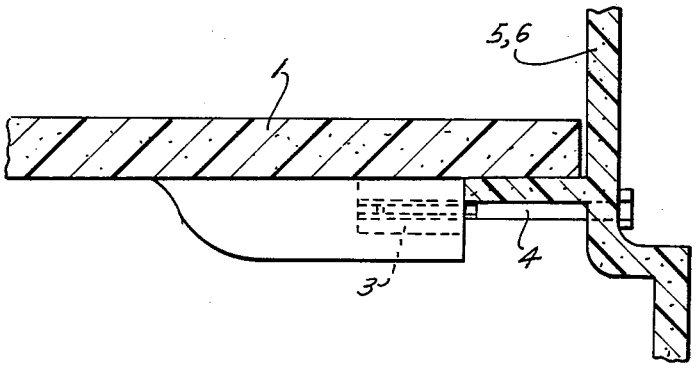
FIG. 3 is a fragmentary section illustrating a detail of FIGS. 1 and 2.

Referring to FIGS. 1–3, it will be seen that reference numeral 1 identifies a tubular core portion of the novel reel, onto which the non-illustrated cables or other convolutable objects are to be wound. The interior surface of the core portion 1 is provided with axially extending reinforcing ribs 2 which are spaced circumferentially on this interior surface from which they project inwardly. The extent to which the ribs 2 project inwardly from the interior surface of the core portion 1 is greatest substantially midway between the opposite open ends of the core portion 1, and decreases in the direction towards the opposite open ends. This means that when cables or similar objects are wound onto the core portion 1, the particular configuration of the ribs 2 assures that the core portion 1 is well able to withstand the stresses acting upon it in the region of the maximum bending moment.

The opposite axial ends of the core portion 1 have embedded in them tapped sleeves 3, which could also be connected with the core portion 1 in another manner securing them nonremovably thereto. Screws or bolts 4 are threaded into these tapped sleeves 3 and serve to hold end flanges 5 and 6 to the core portion 1.

The end flanges 5 and 6 are each provided with an outer circumferential annular portion 7, 8 which is formed with an outer circumferentially extending edge face 7*a*, 8*a*. The portions 7, 8 are axially outwardly offset from the plane of the respectively associated plate portions 5*a*, 6*a* which extend transversely to the longitudinal axis of the tubular core portion 1. Adjacent the plate portions 5*a*, 6*a* each of the edge faces 7*a*, 8*a* is formed with a circumferentially extending depression or recess 9, 10. This construction assures that in the event of sudden stresses acting upon the flanges 5, 6, the latter are capable of yielding but without undergoing permanent deformation. Each of the portions 7, 8 is provided with reinforcing fins 11, 12 which respectively extend from an outer free edge of the portions 7, 8 to the respectively associated plate portions 5*a*, 6*a*. This reinforcement substantially increases the strength and therefore lifetime of the portions 7, 8.

The end flanges 5, 6 are each composed of a radially outer annular flange portion and a radially inner annular flange portion. The end flange 5 has the radially outer annular flange portion 16 and the radially inner annular flange portion 32; the corresponding portions of the end flange 6 are designated with reference numerals 15 and 31, respectively. The inner flange portions 31 and 32 are cupped and have an open side facing axially inwardly of the tubular core portion 1, whereas the outer flange portions 15 and 16 are also cupped, but have their open sides face axially outwardly of the tubular core portion 1, that is in a sense opposite to the direction in which the open side of their respectively associated inner annular flange portion faces. The inner annular flange portions 31 and 32 have tubular sections 31*a* and 32*a*, respectively, which are inserted into the opposite open ends of the tubular core portion 1. The connection with the tubular core portion is effected by inserting bolts or screws 4 through holes provided in the respective end flanges 5, 6 and threading them into the tapped sleeves 3. This is shown for one sleeve 3 and an associated nut or bolt 4 in FIG. 3; it will be understood that there will be a plurality of these connecting portions 3, 4 which are spaced circumferentially of the tubular core portion 1, as is suggested by the broken-line showing of the portions 4 in FIG. 2. The tubular sections 31*a*, 32*a* can be reinforced by means of reinforcing rings 22, 23 which can be recessed into the outer circumferential surfaces of the sections 31*a*, 32*a*, as shown in FIG. 1. These rings 22, 23 may be of synthetic plastic material or of metal. Reinforcing ribs 24 are formed in the interior of each of the inner annular flange portions 31, 32, and are arranged radially, having a height which tapers in direction axially outwardly of the core portion 1.

The radially outer annular flange portions 15, 16, which are of one piece with the respectively associated inner annular flange portions 31, 32, are provided with reinforcing ribs 13, 14 at their axially outer sides. FIG. 2 shows a preferred arrangement of the ribs 13, 14, which are in part bifurcated so as to resemble the letter Y. The fins 11, 12 (this is shown in FIG. 2 only for the fins 12 because FIG. 2 shows the end flange 5) are located in the spaces defined by the respective bifurcations of the ribs 13, 14. This arrangement has the advantage that it saves weight and that in the event of sudden stresses acting upon the flanges, the ribs 13, 14 prevent breaking of the respective flange in the radially outer region of the same.

For various reasons it is frequently desired to be able to bring the inner end of a cable or the like that is wound onto such a reel, to the outside. In other words, the end of a cable or the like which is first wound onto the reel when the winding operation begins, should be accessible, for example, to measure the electrical continuity of a cable, or for other purposes. To make this possible, the axially outer side of at least one of the flanges 5, 6 is formed with an arcuate recess 17 in the region of the ribs 13, 14. This recess extends from an inclined opening 18 in the flange, here the flange 5 as shown in FIG. 2, that is located in the region of the core portion 1, and at its opposite end from the opening 18 the recess 17 is formed with an opening 19 that passes through a rib 20. This has the advantage that after an object such as a cable is wound onto the reel, the inner and outer ends of the cable are located immediately adjacent one another, the inner end having, of course, been passed through the opening 18 and extending along the recess 17 and through the opening 19. This makes it possible to connect test equipment to the opposite axial ends of the cable and readily measure it, while at the same time the inner end which is located in the recess 17 is largely protected against damage by this location.

Both of the end flanges 5, 6 are also provided with a plurality of holes, bores, recesses or the like. In particular, FIG. 2 shows that each of the end flanges 5, 6 is formed in the region of its outer circumference with a plurality of openings 21, and that at least one of the flanges 5, 6 is formed in the region of the core portion 1 with bores or openings 25, 26 and with a recessed area 27. The openings 21 can have rods or similar retaining elements secured in them which extend lengthwise of the reel and which serve to prevent the cable or other element from unwinding. The openings 25 and 26 can have projections of a winding or unwinding apparatus extended into them, so that the reel can be rotated (for example in the direction indicated by the arrow in FIG. 2) to wind a cable or similar object onto it, or to unwind the cable or object from it. The recessed area 27, which may have a different configuration than the one shown in FIG. 2, can receive a label designating details of the object wound onto the reel, which label is protected against damage during storage or transportation due to the fact that it is recessed.

Figure 5:
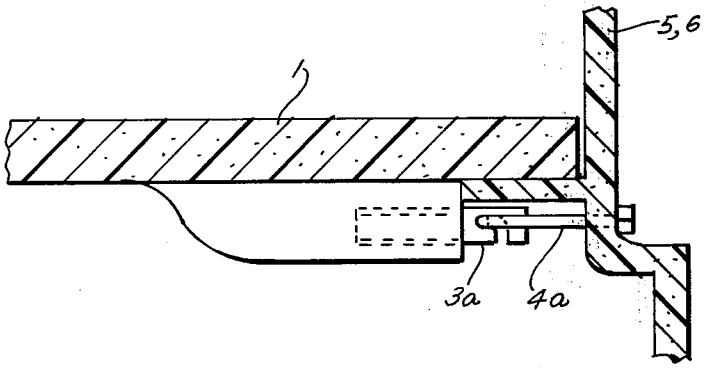
FIG. 5 is a view similar to FIG. 3 but illustrating a somewhat modified embodiment.

FIG. 5 resembles FIG. 3, but shows a somewhat modified embodiment wherein the connecting portions 3*a* can be threadedly adjusted lengthwise of the tubular core portion 1, and the connecting portions 4*a* cooperate with the portions 3*a* in the manner of a bayonet closure. This, therefore, is an alternative to the embodiment in FIG. 3, as to how the end flanges 5 and 6 can be connected to the tubular core portion 1.

Figure 4:
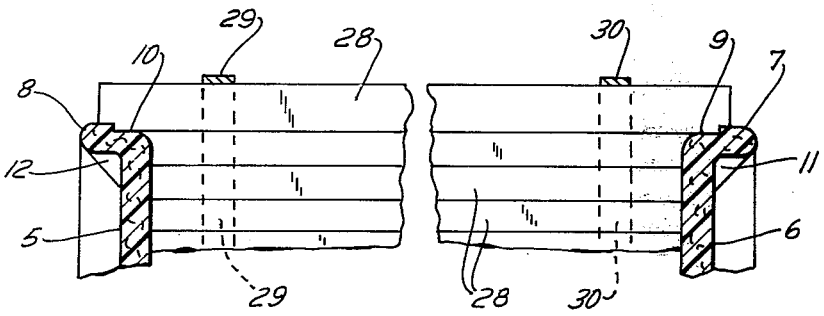
FIG. 4 is a fragmentary axial section illustrating a further embodiment.

The primary purpose of the recesses 9, 10 is to make it possible for the portions 7, 8 to elastically yield to a slight extent in the event they are subjected to stresses, and so as to prevent breakage. However, as FIG. 4 shows, they can serve still another purpose. FIG. 4 shows fragmentarily a mat composed of a plurality of slats 28 of wood or the like, which are located adjacent one another in parallelism, being connected with strips or straps 29, 30 of steel, webbing or the like. This mat is placed around the reel to protect the object wound onto the same, such as a cable, and to prevent it from unwinding. The opposite axial ends of the slats 28 are stepped, as illustrated in FIG. 4, so that they can be firmly received in the recesses 9, 10 and are thus retained against movement.

The core portion 1 and the end flanges 5, 6 may be made of various types of synthetic plastic material. It has been found most advantageous to use structural polyurethane foam which is reinforced with glass fiber mats. However, nonreinforced thermoplastic structural foam materials, particularly structural polyethylene foam, can also be used to advantage. The term "structural foam" is used to designate rigid foams as opposed to the types of foams which are readily compressible and are, for instance, widely employed to make plastic foam sponges and the like. Structural foam is rigid and shape-holding.

The reel according to the present invention can be produced in a very simple manner, since the core portion 1 and the end flanges 5, 6 can be produced by injection molding or the like. It is light in weight and can find a wide variety of uses, not only to hold cables or electrical conductors, but also to hold textile materials, such as yarns or the like. The inherent elasticity of the reel, that is its ability to yield slightly in the event of the transmission of sudden forces, rather than to break, and the behavior of the reel when subjected to the weight of material wound onto it, are excellent and make it highly advantageous. Because the reel can be produced inexpensively to quite close tolerances, it can be used not only as a storage reel, but also as a takeup or pay out reel on machinery. The reel has a rather extended lifetime and requires little or no maintenance throughout its lifetime.

It will be understood that each of the elements described above, or two or more together, may also find a useful application in other types of constructions differing from the type described above.

While the invention has been illustrated and described as embodied in a reel for cables and the like, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by letters Patent is set forth in the appended claims.

1. A reel for elongated convolutable objects, particularly for cables and the like, comprising a tubular core portion having opposite open ends and a hollow interior; a pair of end flanges each having a radial inner annular flange portion which is cupped so as to have an open side facing axially inwardly of said core portion and which is in part received in one of said open ends and a radially outer annular flange portion which is cupped so as to have an open side facing axially outwardly of said core portion, and which has an outer circumferential edge face; connecting means connecting each of said end flanges to said core portion; and a plurality of reinforcing ribs extending radially between said inner and outer annular flange portions, each of said reinforcing ribs having a bifurcated section in the region of the respective outer circumferential edge face and a stem section in the region of said tubular core portion.

2. A reel as defined in claim 1, wherein said inner annular flange portions are provided with reinforcing portions.

3. A reel as defined in claim 1, wherein said bifurcated section comprises two straight portions mutually inclined with respect to each other.

4. A reel for elongated convolutable objects, particularly for cables and the like, comprising a synthetic plastic material tubular core portion having opposite open ends and a hollow interior formed with first reinforcing ribs; a pair of end flanges of synthetic plastic material each having a radially inner annular flange portion which is cupped so as to have an open side facing axially inwardly of said core portion and which is in part received in one of said open ends, and a radially outer annular flange portion which is cupped so as to have an open side facing axially outwardly of said core portion, and which has an outer circumferential edge face; connecting means connecting each of said end flanges to said core portion; and second reinforcing ribs in each of said inner annular flange portions, said second reinforcing ribs extending substantially radially and projecting by a distance which tapers in direction axially outwardly of said core portion.

5. A reel as defined in claim 4, wherein said connecting means comprises tapped sleeves nonremovably mounted at opposite axial ends of said core portion, and screws holding said end flanges and being threaded into the respective tapped sleeves.

6. A reel as defined in claim 4, wherein said connecting means comprises bayonet closures.

7. A reel as defined in claim 4, wherein each of said outer annular flange portions includes a plate part located in a radial plane of said core portion, said outer circumferential edge face of the respective outer annular flange portion being axially offset from said plane and being formed adjacent the plate part with a circumferentially extending recess.

8. A reel as defined in claim 7, wherein each of said outer annular flange portions includes reinforcing fins extending from the respective plate portion to a free edge of the respectively associated edge face.

9. A reel as defined in claim 8, wherein said plate portions are formed with substantially radially extending reinforcing ribs.

10. A reel as defined in claim 4, wherein said connecting means comprises cooperating connecting portions on said core portion and said end flanges, respectively.

11. A reel as defined in claim 3, wherein said core portion and said end flanges are of glass fiber reinforced structural polyurethane foam material.

12. A reel as defined in claim 3, wherein said core portion and said end flanges are of thermoplastic synthetic structural foam material.

13. A reel as defined in claim 3, wherein said core portion and said end flanges are of structural polyethylene foam material.

14. A reel as defined in claim 3, each outer annular flange portion including a plate part located in a radial plane of said core portion, said outer circumferential edge face being axially offset from said plane and being formed adjacent said plate part with a circumferentially extending recess; and further comprising a mat of connected strip elements surrounding said reel and each having opposite ends received in one of said circumferential recesses.

15. A reel as defined in claim 4, wherein said core portion and end flanges are of synthetic plastic material.

16. A reel for elongated convolutable objects, particularly for cables and the like, comprising a tubular core portion having opposite open ends and a hollow interior formed with first reinforcing ribs; a pair of end flanges each having a radially inner annular flange portion which is cupped so as to have an open side facing axially inwardly of said core portion and which is in part received in one of said open ends, and a radially outer annular flange portion which is cupped so as to have an open side facing axially outwardly of said core portion, and which has an outer circumferential edge face, each of said outer annular flange portions including a plate part located in a radial plane of said core portion, said outer circumferential edge face of the respective outer annular flange portion being axially offset from said plane and being formed adjacent the plate part with a circumferentially extending recess each of said outer annular flange portions further including reinforcing fins extending from the respective plate portion to a free edge of the respectively associated edge face, said plate portions being formed with substantially radially extending second reinforcing ribs, at least one of said plate portions being formed with a hole in the region of said core portion and with an arcuate recess which extends from said hole through some of said second reinforcing ribs on said plate portion and in direction towards said edge face thereof.

17. A reel as defined in claim 16, wherein each of said plate portions is formed with circumferentially distributed apertures in the vicinity of the respective edge face, and at least one of said flanges is formed in the region of said core portion with a plurality of bores and with a recessed area.

18. A reel for elongated convolutable objects, particularly for cables and the like, comprising a tubular core portion having opposite open ends, an inner circumferential surface and a hollow interior formed with reinforcing ribs, said reinforcing ribs projecting from said inner circumferential surface at circumferentially-spaced locations and extending axially of said core portion, each of said ribs projecting to a greatest extent substantially midway between said open ends and tapering in direction towards each of said open ends; a pair of end flanges each having a radially inner annular flange portion which is cupped so as to have an open side facing axially inwardly of said core portion and which is in part received in one of said open ends, and a radially outer annular flange portion which is cupped so as to have an open side facing axially outwardly of said core portion, and which has an outer circumferential edge face; and connecting means connecting each of said end flanges to said core portion.

19. A reel for elongated convolutable objects, particularly for cables and the like, comprising a tubular core portion having opposite open ends and a hollow interior formed with first reinforcing ribs; a pair of end flanges each having a radially inner annular flange portion which is cupped so as to have an open side facing axially inwardly of said core portion and which is in part received in one of said open ends, and a radially outer annular flange portion which is cupped so as to have an open side facing axially outwardly of said core portion, and which has an outer circumferential edge face, each of said outer annular flange portions including a plate part located in a radial plane of said core portion, said outer circumferential edge face of the respective outer annular flange portion being axially offset from said plane and being formed adjacent the plate part with a circumferentially extending recess, each of said outer annular flange portions further including reinforcing fins extending from the respective plate portion to a free edge of the respectively associated edge face, said plate portions being formed with substantially radially extending second reinforcing ribs, each of said second reinforcing ribs having a bifurcated section in the region of the respective edge face, each of said reinforcing fins being located within the confines surrounded by one of said bifurcated sections; and connecting means connecting each of said end flanges to said core portion.

* * * * *